US011079129B2

(12) United States Patent
Kim et al.

(10) Patent No.: US 11,079,129 B2
(45) Date of Patent: Aug. 3, 2021

(54) AIR CONDITIONER

(71) Applicant: LG Electronics Inc., Seoul (KR)

(72) Inventors: Daehyoung Kim, Seoul (KR); Junseong Park, Seoul (KR); Jaehwa Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 141 days.

(21) Appl. No.: 16/486,081

(22) PCT Filed: Feb. 6, 2018

(86) PCT No.: PCT/KR2018/001610
§ 371 (c)(1),
(2) Date: Aug. 14, 2019

(87) PCT Pub. No.: WO2018/151454
PCT Pub. Date: Aug. 23, 2018

(65) Prior Publication Data

US 2020/0018501 A1 Jan. 16, 2020

(30) Foreign Application Priority Data

Feb. 14, 2017 (KR) ..... 10-2017-0019839

(51) Int. Cl.
*F24F 11/30* (2018.01)
*F24F 11/84* (2018.01)
(Continued)

(52) U.S. Cl.
CPC ..... *F24F 11/30* (2018.01); *F24F 11/84* (2018.01); *F25B 1/10* (2013.01); *F25B 41/20* (2021.01);
(Continued)

(58) Field of Classification Search
CPC ..... F25B 2313/025; F25B 2313/0253; F25B 2313/0254; F25B 2313/02543;
(Continued)

(56) References Cited

U.S. PATENT DOCUMENTS 8,297,073 B2 * 10/2012 Kawano ..... F25B 13/00 62/468
2011/0048054 A1 * 3/2011 Sekine ..... F25B 13/00 62/324.6

FOREIGN PATENT DOCUMENTS

EP 3093586 A1 * 11/2016 ..... F25B 49/02
EP 3093586 A1 11/2016
(Continued)

OTHER PUBLICATIONS

International Search Report dated Jul. 3, 2018 in International Application No. PCT/KR2018/001610 (4 pgs.).
(Continued)

*Primary Examiner* — Edward F Landrum
*Assistant Examiner* — Rodrigo Royo
(74) *Attorney, Agent, or Firm* — Finnegan, Henderson, Farabow, Garrett & Dunner LLP

(57) ABSTRACT

An air conditioner is disclosed. The air conditioner comprises: an indoor unit having an indoor heat exchanger installed therein; a first outdoor unit having a first outdoor heat exchanger and a first compressor installed therein; a second outdoor unit having a second outdoor heat exchanger and a second compressor installed therein; an auxiliary module which connects the indoor unit, the first outdoor unit, and the second outdoor unit; a first connection line by which the auxiliary module is connected to the first outdoor unit; a second connection line by which the auxiliary module
(Continued)

is connected to the second outdoor unit; and a two-stage compression line by which the first outdoor unit is connected to the second outdoor unit.

7 Claims, 5 Drawing Sheets

(51) Int. Cl.
*F25B 1/10* (2006.01)
*F25B 49/02* (2006.01)
*F25B 41/20* (2021.01)
*F25B 41/26* (2021.01)

(52) U.S. Cl.
CPC ..... *F25B 41/26* (2021.01); *F25B 49/02* (2013.01); *F25B 2313/009* (2013.01); *F25B 2313/025* (2013.01)

(58) Field of Classification Search
CPC ..... F25B 2313/0252; F25B 2313/021–0215; F24F 1/06; F24F 1/26; F24F 1/28; F24F 1/32; F24F 1/68; F24F 11/84; F24F 11/41; F24F 11/42; F24F 11/43
See application file for complete search history.

(56) References Cited

FOREIGN PATENT DOCUMENTS

| | | | | |
|---|---|---|---|---|
| JP | 2008-111585 | A | 5/2008 | |
| JP | 2017-026289 | A | 2/2017 | |
| KR | 10-0818760 | B1 | 4/2008 | |
| KR | 10-0860035 | B1 | 9/2008 | |
| KR | 10-1071409 | B1 | 10/2011 | |
| KR | 10-2014-0123823 | A | 10/2014 | |
| KR | 10-2016-0086652 | A | 7/2016 | |
| WO | WO-2015128980 | A1 * | 9/2015 | ..... F25B 47/02 |

OTHER PUBLICATIONS

European Search Report dated Oct. 15, 2020 in European Application No. 18754419.2 (3 pgs).

* cited by examiner

【Figure 1】
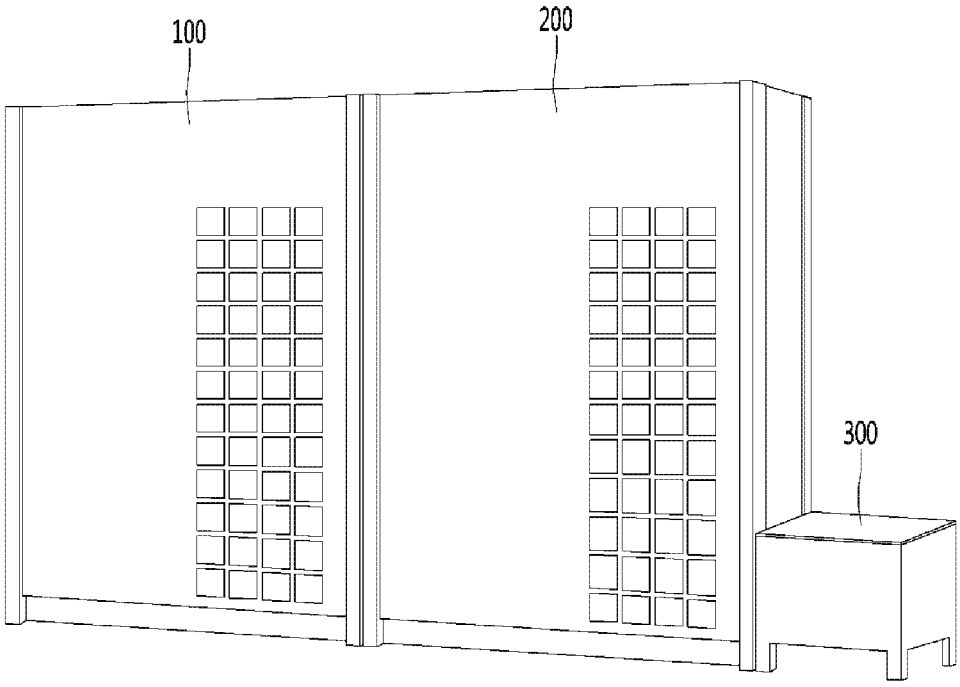

【Figure 2】
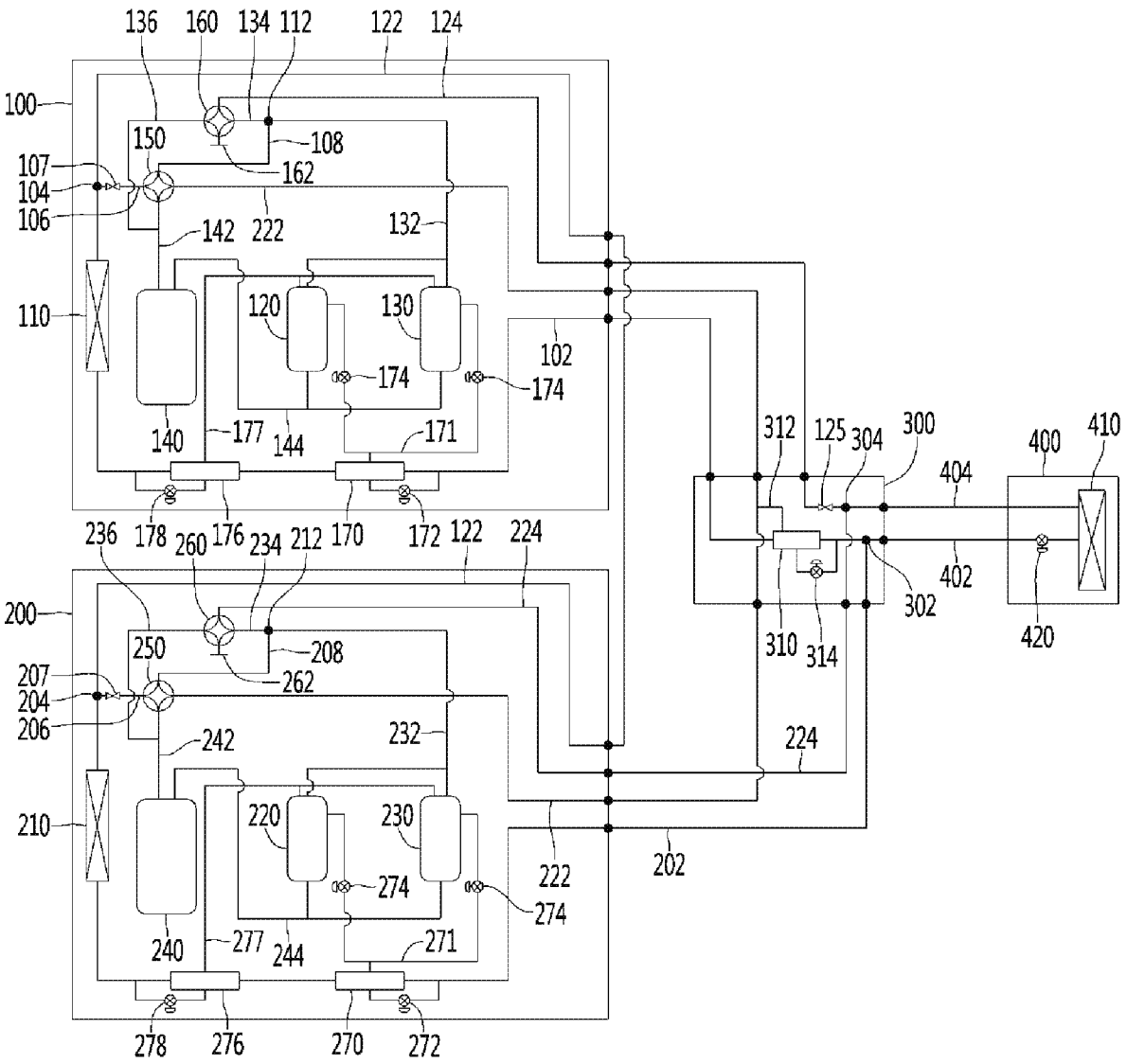

【Figure 3】
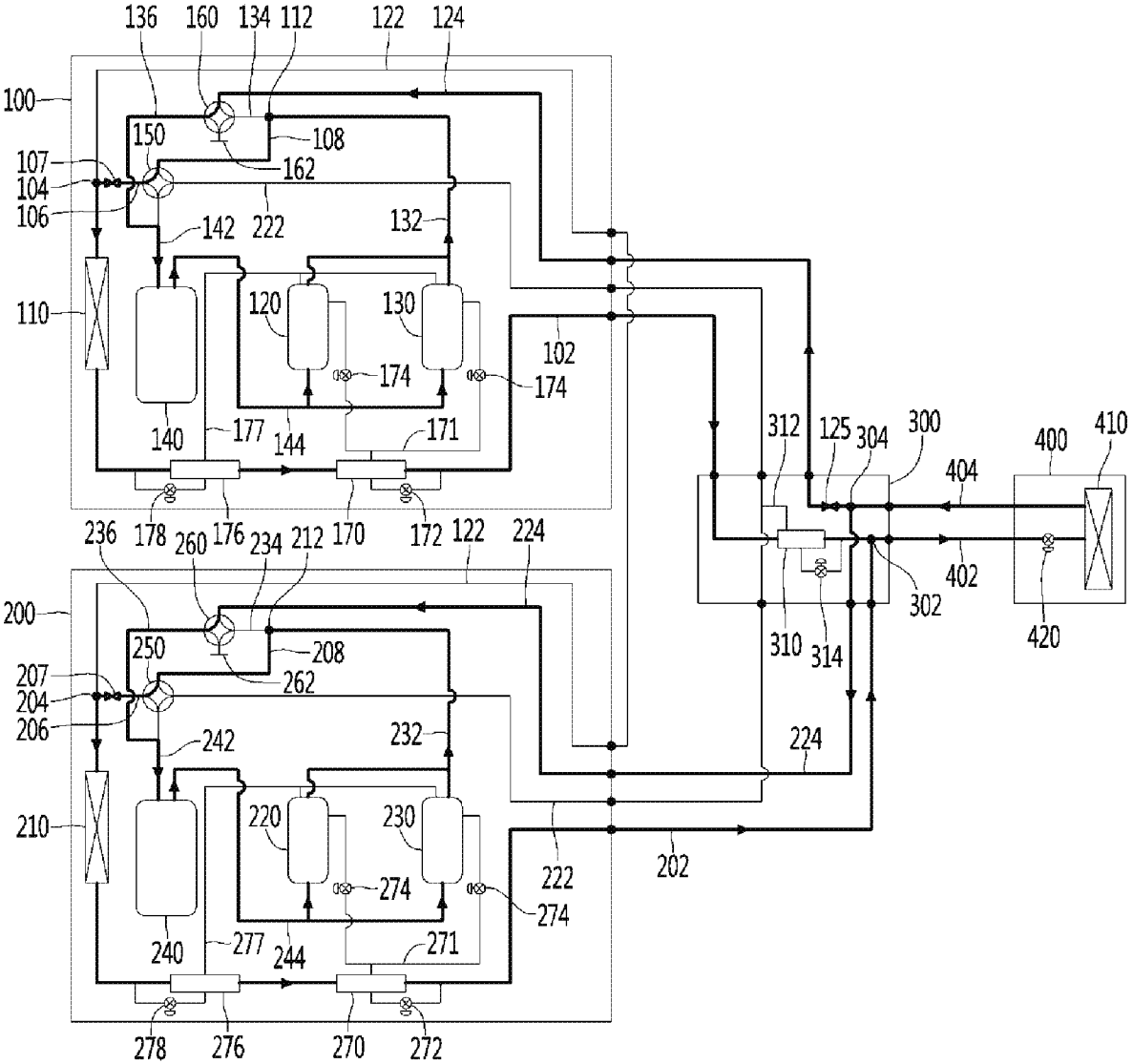

【Figure 4】
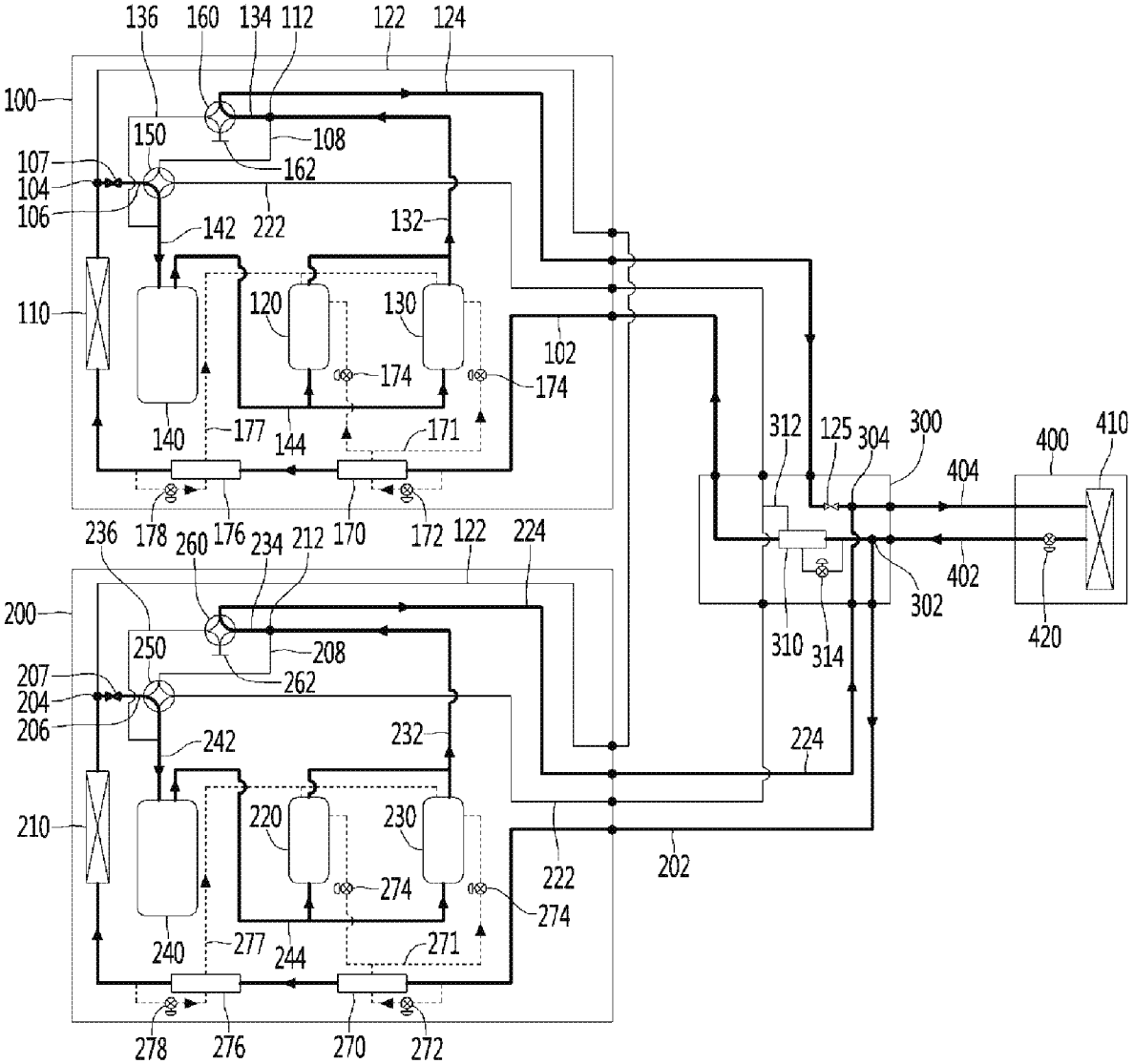

【Figure 5】
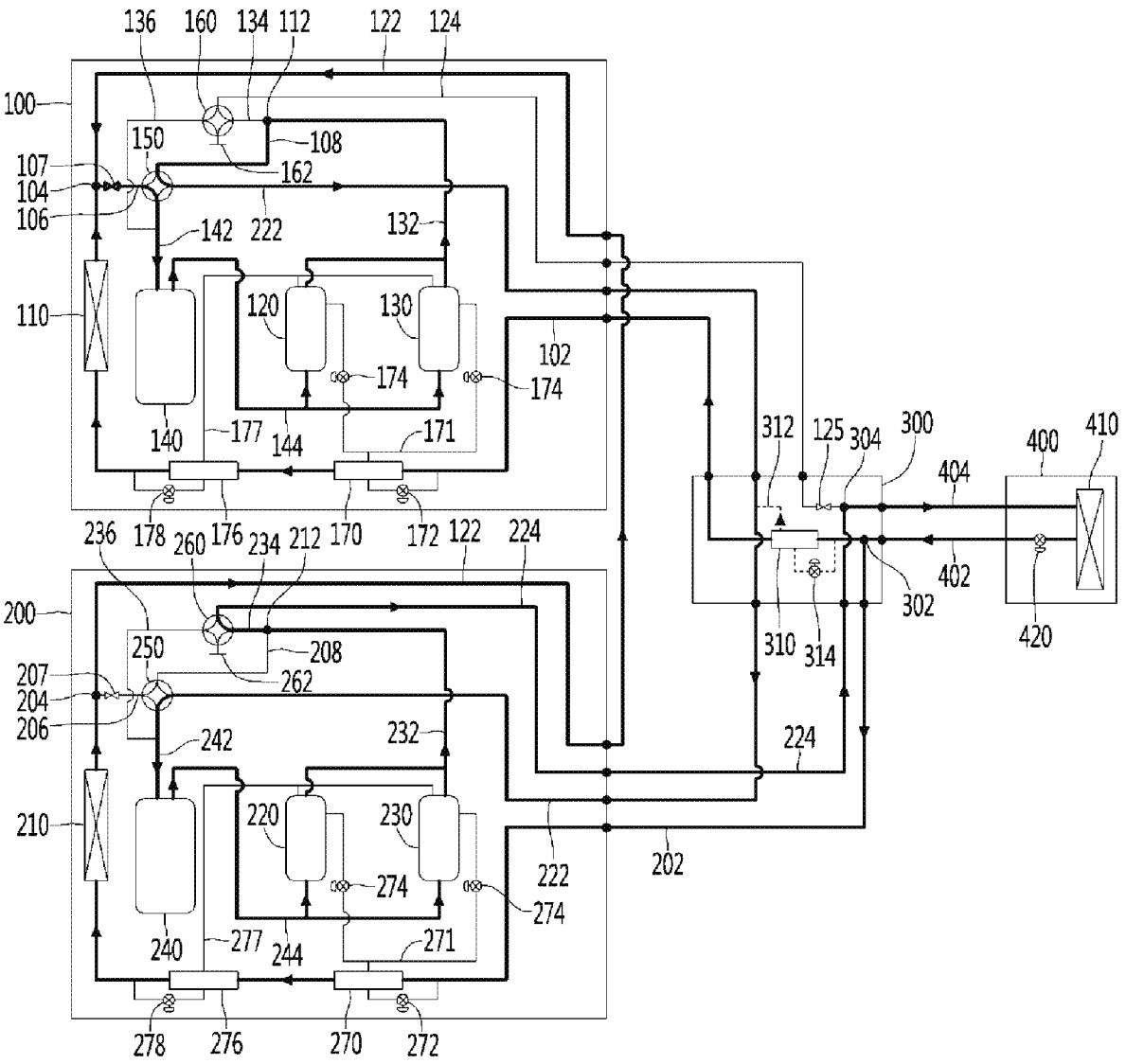

AIR CONDITIONER

CROSS-REFERENCE TO RELATED APPLICATIONS

This application is the U.S. national phase entry under 35 U.S.C. § 371 from PCI International Application No. PCT/KR2018/001610, filed Feb. 6, 2018, which claims the benefit of priority of Korean Patent Application No. 10-2017-0019839, filed Feb. 14, 2017, the contents of all of which are incorporated herein by reference in their entireties.

TECHNICAL FIELD

The present invention relates to an air conditioner.

BACKGROUND ART

An air conditioner is a home appliance for maintaining indoor air in the most appropriate state according to the use and purpose. For example, the air conditioner adjusts an indoor space in a cooling state at low temperature in the summer and adjusts the indoor space in a heating space at high temperature in the winter. In addition, the air conditioner may adjust indoor humidity and may adjust indoor air in a pleasant and clean state.

In detail, a refrigerating cycle in which compression, condensation, expansion, and evaporation procedures of a refrigerant are performed is driven in the air conditioner, and thus a cooling or heating process of an indoor space may be performed.

The air conditioner may be broadly classified into a separation type air conditioner in which an indoor unit and an outdoor unit are separately installed, and an integration type air conditioner in which an indoor unit and an outdoor unit are installed together in one cabinet. An indoor heat exchanger that exchanges heat with indoor air is disposed in the indoor unit, and an outdoor heat exchanger that exchanges heat with outdoor air is disposed in the outdoor unit.

In this case, a plurality of outdoor units may be provided. Each of the plurality of outdoor units includes a compressor and an outdoor heat exchanger.

In general, the plurality of outdoor units are connected in parallel to each other and are each provided in such a way that a refrigerant circulates therein. That is, a refrigerant does not circulate between outdoor units.

However, when being operated in an outdoor environment at very low outdoor temperature, the plurality of outdoor units are connected in series to each other and are multistage compressed on a refrigerant. In this regard, Cited References below are disposed.

(1) Cited Reference 1: Korean Patent Publication No. 10-1071409, registered on Sep. 30, 2011, Hot and cold water producing system using two-stage heat pump cycle (2) Cited Reference 2: Korean Patent Publication No. 10-1196505, registered on Oct. 25, 2012, Heat pomp using two-stage compressor In Cited References 1 and 2 a refrigerant is two-stage compressed and is provided through a plurality of outdoor units, and thus a pressure ratio that is required at very low outdoor temperature may be achieved.

However, such two-stage compression has a problem in that the capability and efficiency of the air conditioner are seriously degraded except for a particular case with very low outdoor temperature. Accordingly, there is a problem in that the air conditioner is inevitably driven ineffectively except for a particular region.

DISCLOSURE

Technical Problem

An object of the present invention devised to solve the problem lies in an air conditioner in which one-stage compression and two-stage compression are switched and used.

In addition, another object of the present invention is provision of an air conditioner in which a separate module box is installed to simplify an internal portion of each outdoor unit.

Technical Solution

In an aspect of the present invention, an air conditioner includes an indoor unit having an indoor heat exchanger installed therein, a first outdoor unit having a first outdoor heat exchanger and a first compressor installed therein, a second outdoor unit having a second outdoor heat exchanger and a second compressor installed therein, an auxiliary module configured to connect the indoor unit, the first outdoor unit, and the second outdoor unit to each other, a first connection line to which the auxiliary module and the first outdoor unit are connected, a second connection line to which the auxiliary module and the second outdoor unit are connected, and a two-stage compression line configured to connect the first outdoor unit and the second outdoor unit to each other.

The auxiliary module may include an auxiliary module valve installed to open the first connection line and to allow a refrigerant to flow to an the indoor unit through the first connection line and the second connection line in a one-stage heating mode, and to close the first connection line and to allow the refrigerant to the indoor unit through only the second connection line in a two-stage heating mode.

The refrigerant flowing in the first connection line and the second connection line may be compressed by the first compressor and the second compressor, respectively, and flows to the auxiliary module along the first connection line and the second connection line, in the one-stage heating mode; and the refrigerant flowing in the first connection line and the second connection line may be compressed by the first compressor and the second compressor, sequentially, and flows to the auxiliary module along the second connection line, in the two-stage heating mode.

The first outdoor unit includes a first main four-way valve and a first auxiliary four-way valve, the second outdoor unit includes a second main four-way valve and a second auxiliary four-way valve, and, when a one-stage heating mode and a two-stage heating mode are switched with each other, any one of the first main four-way valve and the first auxiliary four-way valve, and any one of the second main four-way valve and the second auxiliary four-way valve are reversed.

The first auxiliary four-way valve may be disposed to allow a refrigerant transmitted through the first compressor to flow to the indoor unit, in the one-stage heating mode; and the first auxiliary four-way valve may be disposed to allow a refrigerant transmitted through the first compressor to flow to the second outdoor unit, in the two-stage heating mode.

The second main four-way valve may be disposed to allow a refrigerant transmitted through the second outdoor heat exchanger to flow to the second compressor, in the one-stage heating mode, and the second main four-way valve may be disposed to allow a refrigerant transmitted through the second outdoor heat exchanger to flow to the first outdoor unit, in the two-stage heating mode.

The two-stage compression line may include a first two-stage compression line configured to allow a refrigerant that exchanges heat by the second outdoor heat exchanger to flow to the first outdoor unit, and a second two-stage compression line configured to allow a refrigerant compressed by the first compressor to flow to the second outdoor unit.

The second two-stage compression line may penetrate the auxiliary module and may extend to the second outdoor unit.

The first connection line may include a first heat exchanger input and output line to which the auxiliary module and the first outdoor heat exchanger are connected, and the auxiliary module may further include an auxiliary module injection line configured to connect the first heat exchanger input and output line and the second two-stage compression line to each other.

The auxiliary module injection line may include installed therein, an auxiliary module injection expansion valve configured to expand a refrigerant flowing in the auxiliary module injection line from the first heat exchanger input and output line, and an auxiliary module injection heat exchanger configured to exchange heat between a transmitted through the auxiliary module injection expansion valve and a refrigerant flowing in the first heat exchanger input and output line.

Advantageous Effects

An air conditioner according to an embodiment of the present invention may expect the following effects.

An air conditioner that is driven in a cooling mode, a one-stage heating mode, and a two-stage heating mode and is driven in various driving modes may be advantageously provided.

In particular, in the heating mode, the one-stage heating mode may be generally driven, but the air conditioner may be advantageously operated in the two-stage heating mode when the outdoor air is at very low temperature.

The air conditioner in which a separate module box is installed to switch and use a one-stage heating mode and a two-stage heating mode and an internal portion of each outdoor unit is simplified may be advantageously provided.

Accordingly, it may be advantageous to easily check and repair an outdoor unit.

DESCRIPTION OF DRAWINGS

FIG. 1 is a diagram showing an air conditioner according to an embodiment of the present invention.

FIG. 2 is a diagram showing a refrigerant cycle of an air conditioner according to an embodiment of the present invention.

FIG. 3 is a diagram showing a cooling mode of an air conditioner according to an embodiment of the present invention.

FIG. 4 is a diagram showing a one-stage heating mode of an air conditions according to an embodiment of the present invention.

FIG. 5 is a diagram showing a two-stage heating mode an air conditioner according to an embodiment of the present invention.

BEST MODE

Hereinafter, the present invention will be described in detail by explaining exemplary embodiments of the invention with reference to the attached drawings. However, the features of the present invention are not limited to the proposed embodiments and one of ordinary skill in the art easily can propose other embodiments within the scope of the same feature of the present invention.

FIG. 1 is a diagram showing an air conditioner according to an embodiment of the present invention.

As shown in FIG. 1, the air conditioner may include a plurality of outdoor units. The air conditioner according to the present invention may include two outdoor units.

Hereinafter, one outdoor unit is referred to as a first outdoor unit 100 and another outdoor unit is referred to as a second outdoor unit 200. As shown in FIG. 1, the first outdoor unit 100 and the second outdoor unit 200 may be provided with the same size and shape, but this is merely exemplary and the first outdoor unit 100 and the second outdoor unit 200 may be provided in various configurations.

The first outdoor unit 100 and the second outdoor unit 200 may include at least one opening to allow heat to be exchanged with outdoor air.

The air conditioner may include an auxiliary module 300 connected to a plurality of outdoor units 100 and 200. Although FIG. 1 illustrates the case in which the auxiliary module 300 is installed at one side of the second outdoor unit 200, this is exemplary and the auxiliary module 300 may be provided with various shapes at various positions.

The air conditioner may include an indoor unit 400 connected to the auxiliary module 300. For convenience of description, the indoor unit 400 is omitted in illustration of FIG. 1.

The first outdoor unit 100, the second outdoor unit 200, and the auxiliary module 300 may be positioned in an outdoor space, and the indoor unit 400 may be positioned in an indoor space. The first outdoor unit 100, the second outdoor unit 200, the auxiliary module 300, and the indoor unit 400 may be connected to a refrigerant pipe and may be connected to each other.

Hereinafter, a cycle in which a refrigerant circulates in the first outdoor unit 100, the second outdoor unit 200, the auxiliary module 300, and the indoor unit 400 will be described in detail.

FIG. 2 is a diagram showing a refrigerant cycle of an air conditioner according to an embodiment of the present invention. The terms 'main' and 'auxiliary' used hereinafter are used to distinguish components from each other regardless of the functions thereof.

As described above, the air conditioner may include the outdoor units 100 and 200, the auxiliary module 300, and the indoor unit 400. As shown in FIG. 2, the auxiliary module 300 may be provided to connect the outdoor units 100 and 200 and the indoor unit 400 to each other.

The outdoor units 100 and 200 may include outdoor heat exchangers 110 and 210, compressors 120, 130, 220, and 230, and vapor liquid separators 140 and 240.

The outdoor heat exchangers 110 and 210 may be disposed within the outdoor units 100 and 200 to exchange heat with outdoor air. The outdoor units 100 and 200 may include a blast fan or the like, which is disposed adjacent to the outdoor heat exchangers 110 and 210, but a description thereof is omitted for convenience of description.

The compressor may include main compressors 120 and 220 and auxiliary compressors 130 and 230 which are connected in parallel to each other. The main compressors 120 and 220 and the auxiliary compressors 130 and 230 may be provided with the same performance or may be provided with different shapes or performances if necessary.

The vapor liquid separators 140 and 240 may be disposed at a position before a refrigerant is introduced into the compressor, that is, may be disposed at an inlet of the compressor and may separate a vapor-phase refrigerant. In detail, the vapor-phase refrigerant separated by the vapor liquid separators 140 and 240 may be divided into the main compressors 120 and 220 and may circulate therein.

In detail, the first outdoor unit 100 may include a first outdoor heat exchanger 110, a first main compressor 120, a first auxiliary compressor 130, and a first vapor liquid separator 140. In this case, the first main compressor 120 and the first auxiliary compressor 130 may be referred to as a first compressor.

The second outdoor unit 200 may include a second outdoor heat exchanger 210, a second main compressor 220, a second auxiliary compressor 230, and a second vapor liquid separator 240. In this case, the second main compressor 220 and the second auxiliary compressor 230 may be referred to as a second compressor.

The first outdoor unit 100 may include a first main four-way valve 150 and a first auxiliary four-way valve 160, and the second outdoor unit 200 may include a second main four-way valve 250 and a second auxiliary four-way valve 260.

The indoor unit 400 may include an indoor heat exchanger 410 and an indoor expansion valve 420. For convenience of description, various components installed in the indoor unit 400 are not described and illustrated. The indoor unit 400 may be formed in various shapes and the indoor unit 400 may also be configured in a plural number.

Hereinafter, a refrigerant line for connecting the aforementioned components to each other will be described. The refrigerant line may be understood as a refrigerant pipe in which a refrigerant flows. The term 'branch portion' used hereinafter may refer to a portion obtained by coupling three or more refrigerant pipes.

The indoor unit 400 and the auxiliary module 300 may be connected to each other by a first indoor unit connection line 402 and a second indoor unit connection line 404. In this case, the first indoor unit connection line 402 and the second indoor unit connection line 404 may be referred to as an indoor unit connection line.

The indoor unit connection line 402 is now described, and one end of the first indoor unit connection line 402 may be coupled to the indoor heat exchanger 410, and the other end of the first indoor unit connection line 402 may be coupled to a first branch portion 302 provided within the auxiliary module 300. The indoor expansion valve 420 may be installed in the first indoor unit connection line 402. In particular, the indoor expansion valve 420 may be installed in the first indoor unit connection line 402 positioned within the indoor unit 400.

The first branch portion 302 having one side connected to the first indoor unit connection line 402 may be connected to a first heat exchanger input and output line 102 connected to the first outdoor heat exchanger 110 and a second heat exchanger input and output line 202 connected to the second outdoor heat exchanger 210.

That is, the first heat exchanger input and output line 102 may connect the auxiliary module 300 and the first outdoor unit 100 to each other, and the second heat exchanger input and output line 202 may connect the auxiliary module 300 and the second outdoor unit 200 to each other.

First, the first heat exchanger input and output line 102 is now be described, and one end of the first heat exchanger input and output line 102 may be coupled to the first branch portion 302, and the other end of the first heat exchanger input and output line 102 may be coupled to the first outdoor heat exchanger 110. In detail, the other end of the first heat exchanger input and output line 102 may extend to penetrate the first outdoor heat exchanger 110.

A portion or the first heat exchanger input and output line 102 may be understood as the first outdoor heat exchanger 110 that exchanges heat with outdoor air. The first heat exchanger input and output line 102 that penetrates the first outdoor heat exchanger 110 may be coupled to a second branch portion 104.

That is, the first heat exchanger input and output line 102 may extend from the first branch portion 302 positioned in the auxiliary module 300 to the second branch portion 104 positioned in the first outdoor unit 100.

In order to correspond thereto, the second heat exchanger input and output line 202 may extend from the first branch portion 302 positioned in the auxiliary module 300 to a third branch portion 204 positioned in the second outdoor unit 200. The second outdoor heat exchanger 210 may be installed in the second heat exchanger input and output line 202, and the second outdoor heat exchanger 210 may be understood as a part of the second heat exchanger input and output line 202.

The second branch portion 104 having one side connected to the first heat exchanger input and output line 102 may be connected to a first two-stage compression line 122 and a first main connection line 106.

The first two-stage compression line 122 may connect the second branch portion 104 and the third branch portion 204 of the aforementioned second outdoor unit 200 to each other. That is, the first two-stage compression line 122 may connect the first outdoor unit 100 and the second outdoor unit 200 to each other.

The first main connection line 106 may connect the second branch portion 104 and the aforementioned first main four-way valve 150 to each other. A first main valve 107 may be installed in the first main connection line 106. The first main valve 107 may block flow of a refrigerant of the first main connection line 106.

The first main connection line 106, a first vapor liquid separator introduction line 142, a first auxiliary connection line 108, and a second two-stage compression line 222 may be connected to the first main four-way valve 150. In this case, the first main four-way valve 150 may be operated to connect the first main connection line 106 and the first vapor liquid separator introduction line 142, to the first auxiliary connection line 108 and the second two-stage compression line 222, respectively. The first main four-way valve 150 may be operated to connect the first main connection line 106 and the first auxiliary connection line 108, to the first vapor liquid separator introduction line 142 and the second two-stage compression line 222, respectively.

In this case, the second two-stage compression line 222 may extend to the second main four-way valve 250 of the aforementioned second outdoor unit 200. That is, the second two-stage compression line 222 may connect the first outdoor unit 100 and the second outdoor unit 200 to each other, which is the same as the first two-stage compression line 122. In detail, the second two-stage compression line 222 may penetrate the auxiliary module 300 and may be connected to the first outdoor unit 100 and the second outdoor unit 200.

The first vapor liquid separator introduction line 142 may extend to the aforementioned first vapor liquid separator 140. In addition, the first auxiliary connection line 108 may extend to a fourth branch portion 112.

The fourth branch portion 112 having one side connected to the first auxiliary connection line 108 may be connected to a first auxiliary line 134 and a first compressor ejection line 132.

The first compressor ejection line 132 may be connected to the aforementioned first main compressor 120 and the first auxiliary compressor 130. The first main compressor 120 and the first auxiliary compressor 130 may be connected to the first vapor liquid separator 140 through a first compressor introduction line 144. The first compressor introduction line 144 may also be understood as a first vapor liquid separator ejection line.

In this case, flow of a refrigerant that is transmitted through the first vapor liquid separator 140, the first main compressor 120, and the first auxiliary compressor 130 is now described, and in this case, a refrigerant that flows to the first vapor liquid separator 140 through the first vapor liquid separator introduction line 142 may be separated as vapor and liquid refrigerants and may flow to the first main compressor 120 and the first auxiliary compressor 130 along the first compressor introduction line 144 (the first vapor liquid separator ejection line). The refrigerant compressed in the first main compressor 120 and the first auxiliary compressor 130 may flow to the fourth branch portion 112 along the first compressor ejection line 132.

The first auxiliary line 134 may extend to the aforementioned first auxiliary four-way valve 160.

The first auxiliary line 134, a first cooling line 136, a first auxiliary module connection line 124, and a cutting portion 162 may be connected to the first auxiliary four-way valve 160. In this case, the first auxiliary four-way valve 160 may be operated to connect the first auxiliary line 134 and the first auxiliary module connection line 124, to the first cooling line 136 and the cutting portion 162, respectively. The first auxiliary four-way valve 160 may be operated to connect the first auxiliary line 134 and the cutting portion 162, to the first cooling line 136 and the first auxiliary module connection line 124, respectively.

In this case, the cutting portion 162 may refer to a portion by which a pipe is closed to prevent a refrigerant from flowing.

The first cooling line 136 may extend to the first vapor liquid separator introduction line 142. That is, one end of the first cooling line 136 may be coupled to the first auxiliary four-way valve 160, and the other end of first cooling line 136 may be coupled to one side of the first vapor liquid separator introduction line 142. Accordingly, the first cooling line 136 may be connected to the first vapor liquid separator introduction line 142.

The first auxiliary module connection line 124 may extend to a sixth branch portion 304 positioned in the auxiliary module 300. In this case, the first auxiliary module connection line 124 may be a refrigerant line connecting the auxiliary module 300 and the first outdoor unit 100 to each other together with the first heat exchanger input and output line 102 and may be referred to as a first connection line.

The sixth branch portion 304 having one side connected to the first auxiliary module connection line 124 may be connected to the aforementioned second indoor unit connection line 404 and a second auxiliary module connection line 224.

The second auxiliary module connection line 224 may extend to the second auxiliary four-way valve 260 of the aforementioned second outdoor unit 200.

The second outdoor unit 200 may include a refrigerant line corresponding to the first outdoor unit 100. With regard to corresponding configurations, a refrigerant line installed in the first outdoor unit 100 may be referred to as a 'first refrigerant line' and a refrigerant line installed in the second outdoor unit 200 may be referred to as a 'second refrigerant line'.

Accordingly, the second outdoor unit 200 may include a second main connection line 206, a second vapor liquid separator introduction line 242, a second compressor introduction line 244 (a second vapor liquid ejection line), a second compressor election line 232, a second auxiliary line 234, a cutting portion 262, second auxiliary connection line 208, and a second cooling line 236.

A second main valve 207 may be installed in the second main connection line 206 block flowing of a refrigerant. The second outdoor unit 200 may include a fifth branch portion 212 corresponding to the fourth branch portion 112 of the first outdoor unit 100.

The above description of the refrigerant line of the first outdoor unit 100 is referred to and a description of the refrigerant line of the second outdoor unit 200 is omitted.

As described above, the auxiliary module 300 may include the first branch portion 302 and the sixth branch portion 304, and may be connected to the first heat exchanger input and output line 102, the second heat exchanger input and output line 202, the first indoor unit connection line 402, the first auxiliary module connection line 124, the second auxiliary module connection line 224, and the second indoor unit connection line 404.

In this case, the second auxiliary module connection line 224 and the second heat exchanger input and output line 202 may be a refrigerant line that connects the auxiliary module 300 and the second outdoor unit 200 to each other and may be referred to as a second connection line.

In this case, an auxiliary module valve 125 may be installed in the first auxiliary module connection line 124.

The second two-stage compression line 222 may penetrate the auxiliary module 300 and may extend. Although FIG. 2 illustrates the case in which the first two-stage compression line 122 connects the first indoor unit 100 and the second indoor unit 200 to each other rather than penetrating the auxiliary module 300, the first two-stage compression line 122 may also be installed to penetrate an internal portion of the auxiliary module 300 as necessary.

In this case, the first two-stage compression line 122 and the second two-stage compression line 222 are a refrigerant line that connects the first outdoor unit 100 and the second outdoor unit 200 to each other and may be referred to as a two-stage compression line.

The air conditioner may include an injection heat exchanger and an injection valve to which vapor injection technology is applied. The injection heat exchanger and the injection valve may be installed in a plural number and may also be installed at various positions.

As shown in FIG. 2, the air conditioner according to the present invention may be configured in such a way that two injection heat exchangers are installed in the first outdoor unit and two injection heat exchangers are installed in the second outdoor unit to correspond to the two injection heat exchangers installed in first outdoor unit. One injection heat exchanger may be installed in the auxiliary module.

In detail, a first main injection heat exchanger 170 and a first auxiliary injection heat exchanger 176 may be installed in the first heat exchanger input and output line 102. For convenience of description, a heat exchanger disposed adjacent to the first branch portion 302 may be referred to as the first main injection heat exchanger 170, and a heat exchanger disposed adjacent to the first outdoor heat exchanger 110 may be referred to as the first auxiliary injection heat exchanger 176.

A refrigerant line in which the first main injection heat exchanger 170 is installed may be referred to as a first main injection line 171, and a refrigerant line in which the first auxiliary injection heat exchanger 176 is installed may be referred to as a first auxiliary injection line 177.

A first main injection expansion valve 172 and a first auxiliary injection expansion valve 178 may be installed in the first main injection line 171 and the first auxiliary injection line 177. At least one first injection valve 174 may be installed in the first main injection line 171 and the first auxiliary injection line 177. In this case, the first injection valve 174 may be understood as a valve configure to open or close flowing of a refrigerant.

The first main injection line 171 and the first auxiliary injection line 176 may extend to the first main compressor 120 and the first auxiliary compressor 130. That is, the first main injection line 171 and the first auxiliary injection line 176 may connect the first heat exchanger input and output line 102 to the first main compressor 120 and the first auxiliary compressor 130.

The second outdoor unit 200 may also include a second main injection heat exchanger 270, a second auxiliary injection heat exchanger 276, a second main injection line 271, a second auxiliary injection line 277, a second main injection expansion valve 272, a second auxiliary injection expansion valve 278, and a second injection valve 274, which correspond to the second outdoor unit 200.

The auxiliary module 300 may include an auxiliary module injection heat exchanger 310, an auxiliary module injection line 312, and an auxiliary module injection expansion valve 314. The auxiliary module injection line 312 may connect the second two-stage compression line 222 and the first heat exchanger input and output line 102 to each other.

Hereinafter, each mode of an air conditioner that is operated in various driving modes through such a refrigerant cycle will be described. Flow in which a refrigerant circulates is indicated by a solid line, and flowing of a refrigerant is blocked or refrigerant barely flows at dynamic pressure in the remaining part.

FIG. 3 is a diagram showing a cooling mode of an air conditioner according to an embodiment of the present invention.

In a cooling mode, the indoor heat exchanger 410 may function as an evaporator, and the outdoor heat exchangers 110 and 210 may function as a condenser. Accordingly, a refrigerant may circulate in a compressor, an outdoor heat exchanger, an expansion valve, and an indoor heat exchanger, sequentially.

Hereinafter, a cycle of a refrigerant from the indoor heat exchanger 410 as a start point will be described in detail.

A refrigerant ejected from the indoor heat exchanger 410 may flow to the auxiliary module 300 from the indoor unit 400 along the second indoor unit connection line 404. A refrigerant flowing to the sixth branch portion 304 may be branched into plural ways and may flow to the first outdoor unit 100 and the second outdoor unit 200 from the auxiliary module 300 along the first auxiliary module connection line 124 and the second auxiliary module connection line 224, respectively.

A refrigerant flowing to the first outdoor unit 100 along the first auxiliary module connection line 124 may flow in the first cooling line 136 from the first auxiliary four-way valve 160. The refrigerant may be introduced to the first vapor liquid separator 140 through the first vapor liquid separator introduction line 142 connected to the first cooling line 136.

Continuously, the refrigerant may be ejected from the first vapor liquid separator 140, may be compressed by the first main compressor 120 and the first auxiliary compressor 130 along the first compressor introduction line 144, and may be ejected to the first compressor ejection line 132.

The ejected refrigerant may flow along the first auxiliary connection line 108 from the fourth branch portion 112 and may flow in the first main connection line 106 from the first main four-way valve 150. The refrigerant may flow to the second branch portion 104 along the first main connection line 106 and may be transmitted through the first outdoor heat exchanger 110 along the first heat exchanger input and output line 102.

Lastly, the refrigerant may flow the auxiliary module 300 from the first outdoor unit 100 along the first heat exchanger input and output line 102 and may flow to the indoor unit 400 from the auxiliary module 300 along the first indoor unit connection line 402 from the first branch portion 302. The refrigerant may expand in the indoor expansion valve 420 and may flow and circulate again in the indoor heat exchanger 410.

In order to correspond thereto, a refrigerant that flows to the second outdoor unit 200 along the second auxiliary module connection line 224 may be transmitted through the second cooling line 236, the second vapor liquid separator introduction line 242, the second compressor introduction line 244, the second compressor election line 232, the second auxiliary connection line 208, and the second main connection line 206, and may flow to the auxiliary module 300 from the second outdoor unit 200 along the second heat exchanger input and output line 202.

The refrigerant flowing to the auxiliary module 300 may be combined with the refrigerant transmitted through the first outdoor unit 100 from the first branch portion 302 and may flow to the indoor unit 400.

FIG. 4 is a diagram showing a one-stage heating mode of an air conditioner according to an embodiment of the present invention. The one-stage heating mode may correspond to a heating mode that is generally executed when heating is required.

In the one-stage heating mode, the indoor heat exchanger 410 may function as a condenser and the outdoor heat exchangers 110 and 210 may function as an evaporator. Accordingly, a refrigerant may circulate in a compressor, an indoor heat exchanger, an expansion valve, and an outdoor heat exchanger, sequentially.

Hereinafter, a cycle of a refrigerant from the indoor heat exchanger 410 as a start point will be described in detail.

A refrigerant ejected from the indoor heat exchanger 410 may flow to the auxiliary module 300 from the indoor unit 400 along the first indoor unit connection line 402. In this case, the refrigerant may be transmitted through the indoor expansion valve 420 and may expand.

A refrigerant flowing to the first branch portion 302 may be branched into plural ways and may flow to the first outdoor unit 100 and the second outdoor unit 200 from the auxiliary module 300 along the first heat exchanger input and output line 102 and the second heat exchanger input and output line 202, respectively.

A refrigerant flowing to the first outdoor unit 100 along the first heat exchanger input and output line 102 may be transmitted through the first outdoor heat exchanger 110 and may flow in the second branch portion 104. The refrigerant may flow in the first main connection line 106 from the second branch portion 104 and may flow in the first vapor liquid separator introduction line 142 from the first main four-way valve 150.

A refrigerant introduced to the first vapor liquid separator 140 through the first vapor liquid separator introduction line 142 may be ejected from the first vapor liquid separator 140, may be compressed by the first main compressor 120 and the first auxiliary compressor 130 along the first compressor introduction line 144, and may be ejected to the first compressor ejection line 132.

The ejected refrigerant may flow along the first auxiliary line 134 from the fourth branch portion 112 and may flow in the first auxiliary module connection line 124 from the first auxiliary four-way valve 160.

Lastly, the refrigerant may flow to the auxiliary module 300 from the first outdoor unit 100 along the first auxiliary module connection line 124, and may flow to the indoor unit 400 from the auxiliary module 300 along the second indoor unit connection line 404 from the sixth branch portion 304. Accordingly, the refrigerant may flow and circulate again in the indoor heat exchanger 410.

In order to correspond thereto, a refrigerant that flows to the second outdoor unit 200 along the second heat exchanger input and output line 202 may be transmitted through the second main connection line 206, the second vapor liquid separator introduction line 242, the second compressor introduction line 244, the second compressor election line 232, and the second auxiliary line 234, and may flow to the auxiliary module 300 from the second outdoor unit 200 along the second auxiliary module connection line 224.

The refrigerant flowing to the auxiliary module 300 may be combined with the refrigerant transmitted through the first outdoor unit 100 from the sixth branch portion 304 and may flow to the indoor unit 400.

In a one-stage heating mode, a refrigerant may flow to an injection heat exchanger and an injection expansion valve as necessary. Flow of such a refrigerant is indicated by a dotted line in FIG. 4.

A portion of a refrigerant flowing along the first heat exchanger input and output line 102 may flow along the first main injection line 171. The refrigerant flowing along the first main injection line 171 may expand in the first main injection expansion valve 172.

The first main injection heat exchanger 170 may exchange heat between a refrigerant flowing along the first heat exchanger input and output line 102 and a refrigerant flowing along the first main injection line 171. In detail, heat of a refrigerant, pressure and temperature of which are lowered while being transmitted through the first main injection expansion valve 172, may be exchanged with heat of a refrigerant introduced in the first heat exchanger input and output line 102.

Accordingly, a refrigerant transmitted through the first main injection line 171 may receive heat and may evaporate, and heat may be taken away from a refrigerant transmitted through the first heat exchanger input and output line 102.

The refrigerant that evaporates in the first main injection heat exchanger 170 may be supplied to the first main compressor 120 and the first auxiliary compressor 130.

A refrigerant that is transmitted through the first main injection heat exchanger 170 and flows along the first heat exchanger input and output line 102 may further lose heat while being transmitted through the first auxiliary injection heat exchanger 176.

The second main injection heat exchanger 270 and the second auxiliary injection heat exchanger 276 which are installed in the second outdoor unit 200 may also be operated as such.

A user may control the first main injection expansion valve 172, the first auxiliary injection expansion valve 178, first injection valve 174, the second main injection expansion valve 272, the second auxiliary injection expansion valve 278, and the second injection valve 274 and may selectively use them as necessary.

FIG. 5 is a diagram showing a two-stage heating mode of an air conditioner according to an embodiment of the present invention. The two-stage heating mode may correspond to a heating mode that is executed in a particular case with very low outdoor temperature. For example, the two-stage heating mode may be executed when outdoor temperature is 20 degrees below zero or less.

In the two-stage heating mode, the indoor heat exchanger 410 may function as a condenser, and the outdoor heat exchangers 110 and 210 may function as an evaporator like a general heating mode. Accordingly, a refrigerant may circulate a compressor, an indoor heat exchanger, an expansion valve, and an outdoor heat exchanger, sequentially.

Hereinafter, a cycle of a refrigerant from the indoor heat exchanger 410 as a start point will be described in detail.

A refrigerant ejected from the indoor heat exchanger 410 may flow to the auxiliary module 300 from the indoor unit 400 along the first indoor unit connection line 402. In this case, the refrigerant may be transmitted through the indoor expansion valve 420 and may expand.

A refrigerant flowing to the first branch portion 302 may be branched into plural ways and may flow to the first outdoor unit 100 and the second outdoor unit 200 from the auxiliary module 300 along the first heat exchanger input and output line 102 and the second heat exchanger input and output line 202, respectively.

A refrigerant flowing to the first outdoor unit 100 along the first heat exchanger input and output line 102 may be transmitted through the first outdoor heat exchanger 110 and may flow to the second branch portion 104.

A refrigerant flowing to the second outdoor unit 200 along the second heat exchanger input and output line 202 may be transmitted through the second outdoor heat exchanger 210 and may flow to the third branch portion 204.

The refrigerant may flow to the first two-stage compression line 122 from the third branch portion 204. In this case, the second main valve 207 installed in the second main connection line 206 may block flow of the refrigerant. Accordingly, the refrigerant may flow to the first outdoor unit 100 from the second outdoor unit 200 along the first two-stage compression line 122.

The refrigerant flowing to the first outdoor unit 100 may be combined with the refrigerant transmitted through the first outdoor heat exchanger 110 from the second branch portion 104 and may flow to the first main connection line 106. That is, the refrigerant transmitted through the first outdoor heat exchanger 110 and the refrigerant transmitted through the second outdoor heat exchanger 210 may be mixed and may flow.

The refrigerant flowing in the first main connection line 106 from the second branch portion 104 may flow to the first vapor liquid separator introduction line 142 from the first main four-way valve 150.

The refrigerant introduced to the first vapor liquid separator 140 through the first vapor liquid separator introduction line 142 may be ejected from the first vapor liquid separator 140, may be compressed by the first main compressor 120 and the first auxiliary compressor 130 along the first compressor introduction line 144, and may be ejected to the first compressor ejection line 132.

The ejected refrigerant may flow along the first auxiliary connection line 108 from the fourth branch portion 112 and may flow to the second two-stage compression line 222 from the first main four-way valve 150.

Accordingly, the refrigerant may flow to the second outdoor unit 200 from the first outdoor unit 100 along the second two-stage compression line 222. In this case, the second two-stage compression line 222 may penetrate the auxiliary module 300.

The refrigerant flowing to the second outdoor unit 200 may flow to the second vapor liquid separator introduction line 242 from the second main four-way valve 250.

The refrigerant introduced to the second vapor liquid separator 240 through the second vapor liquid separator introduction line 242 may be ejected from the second vapor liquid separator 240, may be compressed by the second main compressor 220 and the second auxiliary compressor 230 along the second compressor introduction line 244, and may be ejected to the second compressor ejection line 232.

The ejected refrigerant may flow through the second auxiliary line 234 from the fifth branch portion 212 and may flow in the second auxiliary module connection line 224 from the second auxiliary four-way valve 260.

Lastly, the refrigerant may flow to the auxiliary module 300 from the second outdoor unit 200 along the second auxiliary module connection line 224 and may flow along the second indoor unit connection line 404 from the sixth branch portion 304. In this case, the auxiliary module valve 125 may block flow of the refrigerant. Accordingly, the refrigerant flowing to the indoor unit 400 from the auxiliary module 300 may flow and circulate again in the indoor heat exchanger 410.

That is, in the one-stage heating mode, the auxiliary module valve 125 may open the first auxiliary module connection line 124 to flow the refrigerant to the indoor unit through the first auxiliary module connection line 124 and the second auxiliary module connection line 224, and in the two-stage heating mode, the auxiliary module valve 125 may be operated to flow the refrigerant to the indoor unit through only the second auxiliary module connection line 224.

As such, in the two-stage heating mode, the first outdoor unit 100 and the second outdoor unit 200 may be operated as if they are one unit differently from in the cooling mode and the one-stage heating mode in which the first outdoor unit 100 and the second outdoor unit 200 are independently operated.

In summary, the refrigerant introduced from the indoor heat exchanger 410 may be branched into plural ways and may flow to the first outdoor heat exchanger 110 and the second outdoor heat exchanger 210, respectively. The refrigerant that evaporates in the first outdoor heat exchanger 110 and the second outdoor heat exchanger 210 may be recombined and may be compressed by the first main compressor 120 and the first auxiliary compressor 130 (one-stage compression).

The one-step compressed refrigerant may be re-compressed by the second main compressor 220 and the second auxiliary compressor 230 (two-stage compression). As such, the two-stage compressed refrigerant may be re-provided to the indoor heat exchanger 410.

That is, in the one-stage heating mode, the refrigerant flowing in the first heat exchanger input and output line 102 and the second heat exchanger input and output line 202 may be compressed by the first compressors 120 and 130 and the second compressors 220 and 230, respectively, and may flow to the auxiliary module 300 along the first auxiliary module connection line 124 and the second auxiliary module connection line 224.

In the two-stage heating mode, the refrigerant flowing in the first heat exchanger input and output line 102 and the second heat exchanger input and output line 202 may be compressed by the first compressors 120 and 130 and the second compressors 220 and 230, sequentially, and may flow to the auxiliary module 300 along the second auxiliary module connection line 224.

Comparing the one-stage heating mode and the two-stage heating mode, maximum efficiency may be achieved in the one-stage heating mode, and a maximum pressure ratio may be achieve in the two-stage heating mode. Accordingly, according to an external condition, the one-stage heating mode and the two-stage heating mode may be switched and used to perform appropriate heating.

In the two-stage heating mode, a refrigerant may flow to the injection heat exchanger and the injection expansion valve if necessary. Such flow of the refrigerant is indicated by a dotted line in FIG. 5. In addition, the aforementioned injection line in the one-stage heating mode may also be used in the two-stage heating mode. With regard to this, the above description of the one-stage heating mode is referred to and a description of the injection line is omitted.

As described above, the auxiliary module 300 may include the auxiliary module injection heat exchanger 310, the auxiliary module injection line 312, and the auxiliary module injection expansion valve 314.

A portion of a refrigerant flowing along the first heat exchanger input and output line 102 may flow along the auxiliary module injection line 312. The refrigerant flowing along the auxiliary module injection line 312 may expand in the auxiliary module injection expansion valve 314.

The auxiliary module injection heat exchanger 310 may exchange heat between a refrigerant flowing along the first heat exchanger input and output line 102 and a refrigerant flowing along the auxiliary module injection line 312. In detail, heat of a refrigerant, pressure and temperature of which are lowered while being transmitted through the auxiliary module injection expansion valve 314, may be exchanged with heat of a refrigerant introduced in the first heat exchanger input and output line 102.

Accordingly, a refrigerant transmitted through the auxiliary module injection line 312 may receive heat and may evaporate, and heat may be taken away from a refrigerant transmitted through the first heat exchanger input and output line 102.

The refrigerant that evaporates in the auxiliary module injection heat exchanger 310 may be supplied to the second two-stage compression line 222. That is, the refrigerant may be supplied to the second main compressor 220 and the second auxiliary compressor 230 along the second two-stage compression line 222.

A user may control the auxiliary module injection expansion valve 314 to selectively use the same if necessary.

As such, the air conditioner according to the feature of the present invention may be used in the cooling mode, the one-stage heating mode, and the two-stage heating mode using the same refrigerant pipe. In particular, the one-stage heating mode and the two-stage heating mode may be switched and used according to the outdoor temperature, and thus high capability and high efficiency driving may be achieved.

The invention claimed is:

1. An air conditioner comprising:

an indoor unit having an indoor heat exchanger installed therein;

a first outdoor unit having a first outdoor heat exchanger and a first compressor installed therein;

a second outdoor unit having a second outdoor heat exchanger and a second compressor installed therein;

an auxiliary module configured to connect the indoor unit, the first outdoor unit, and the second outdoor unit to each other;

a first connection line to which the auxiliary module and the first outdoor unit are connected;

a second connection line to which the auxiliary module and the second outdoor unit are connected; and a two-stage compression line configured to connect the first outdoor unit and the second outdoor unit to each other, wherein the two-stage compression line includes:

a first two-stage compression line configured to allow a refrigerant that exchanges heat by the second outdoor heat exchanger to flow to the first outdoor unit; and a second two-stage compression line configured to allow a refrigerant compressed by the first compressor to flow to the second outdoor unit, wherein the first connection line includes a first heat exchanger input and output line to which the auxiliary module and the first outdoor heat exchanger are connected, wherein the auxiliary module further includes an auxiliary module injection line configured to connect the first heat exchanger input and output line and the second two-stage compression line to each other, and wherein the auxiliary module injection line includes installed therein:

an auxiliary module injection expansion valve configured to expand a refrigerant flowing in the auxiliary module injection line from the first heat exchanger input and output line; and an auxiliary module injection heat exchanger configured to exchange heat between a transmitted through the auxiliary module injection expansion valve and a refrigerant flowing in the first heat exchanger input and output line.

2. The air conditioner of claim 1, wherein the auxiliary module includes an auxiliary module valve installed to open the first connection line and to allow a refrigerant to flow to the indoor unit through the first connection line and the second connection line in a one-stage heating mode, and to close the first connection line and to allow the refrigerant to the indoor unit through only the second connection line in a two-stage heating mode.

3. The air conditioner of claim 2, wherein the refrigerant flowing in the first connection line and the second connection line is compressed by the first compressor and the second compressor, respectively, and flows to the auxiliary module along the first connection line and the second connection line, in the one-stage heating mode; and wherein the refrigerant flowing in the first connection line and the second connection line is compressed by the first compressor and the second compressor, sequentially, and flows to the auxiliary module along the second connection line, in the two-stage heating mode.

4. The air conditioner of claim 1, wherein the first outdoor unit includes a first main four-way valve and a first auxiliary four-way valve;

wherein the second outdoor unit includes a second main four-way valve and a second auxiliary four-way valve; and wherein, when a one-stage heating mode and a two-stage heating mode are switched with each other, any one of the first main four-way valve and the first auxiliary four-way valve, and any one of the second main four-way valve and the second auxiliary four-way valve are configured to reverse the flow therethrough.

5. The air conditioner of claim 4, wherein the first auxiliary four-way valve is disposed to allow a refrigerant transmitted through the first compressor to flow to the indoor unit, in the one-stage heating mode; and wherein the first auxiliary four-way valve is disposed to allow a refrigerant transmitted through the first compressor to flow to the second outdoor unit, in the two-stage heating mode.

6. The air conditioner of claim 4, wherein the second main four-way valve is disposed to allow a refrigerant transmitted through the second outdoor heat exchanger to flow to the second compressor, in the one-stage heating mode; and wherein the second main four-way valve is disposed to allow a refrigerant transmitted through the second outdoor heat exchanger to flow to the first outdoor unit, in the two-stage heating mode.

7. The air conditioner of claim 1, wherein the second two-stage compression line penetrates the auxiliary module and extends to the second outdoor unit.

* * * * *